United States Patent [19]

Rosenberg et al.

[11] Patent Number: 4,850,688

[45] Date of Patent: Jul. 25, 1989

[54] OPTICAL PERSONAL INPECTION INSTRUMENT

[76] Inventors: Irving Rosenberg, 1225 Fairy Hill Rd., Jenkintown, Pa. 19046; James O. Kuhn, 140 Nassau St., New York, N.Y. 10038

[21] Appl. No.: 199,752

[22] Filed: May 27, 1988

[51] Int. Cl.[4] ..... A61B 1/06; A61B 1/22; G02B 5/10; G02B 7/18

[52] U.S. Cl. ..... 350/621; 350/624; 362/139

[58] Field of Search ..... 350/621, 624, 623, 618, 350/619, 620; 362/138, 139, 135; 128/21, 22

[56] References Cited

U.S. PATENT DOCUMENTS

| | | | |
|---|---|---|---|
| 404,021 | 5/1889 | Tile | 350/621 |
| 1,607,163 | 11/1926 | Kinter | 350/621 |
| 2,133,839 | 10/1938 | Addor | 362/139 |
| 2,172,840 | 9/1939 | Geffob | 350/621 |
| 2,598,291 | 5/1952 | O'Brien | 362/139 |
| 2,943,184 | 6/1960 | Christopherson | 362/139 |
| 3,459,178 | 8/1969 | Fleming | 362/139 |
| 4,040,419 | 8/1977 | Goldman | 350/618 |
| 4,623,955 | 11/1986 | Santini | 362/139 |

*Primary Examiner*—Jon W. Henry
*Attorney, Agent, or Firm*—Michael Ebert

[57] ABSTRACT

An optical personal inspection instrument enabling an individual, without any assistance, to examine a body orifice or any other body site otherwise not visually accessible. The instrument is provided with a hand-held platform on which a flashlight unit is hingedly supported by an adjustable beam whereby the unit may be more or less raised with respect to the platform and angled to assume an orientation at which a light beam projected from the unit is directed to illuminate the site of interest. Supported behind and above the unit at the upper end of a telescoping arm of adjustable length is a concave mirror, the lower end of the arm being hingedly attached to the adjustable beam at a point thereon adjacent its lower end. Supported in front and below the unit by an adjustable linkage hingedly attached to the front end of the unit is a concave magnifying mirror, whereby this mirror may be oriented to receive and enlarge a reversed image of the illuminated site and to cast this image on the concave mirror which reverses the reversed image and directs it to the eyes of the individual.

7 Claims, 2 Drawing Sheets

OPTICAL PERSONAL INPECTION INSTRUMENT

BACKGROUND OF INVENTION

1. Field of Invention

This invention relates generally to an optical personal inspection instrument making it possible for an individual, without assistance and in the privacy of his home, to examine an illuminated body orifice or other body site of interest not otherwise visually accessible, and more particularly to a hand-held instrument which includes a flashlight unit to illuminate the site of interest and mirrors associated therewith to direct an illuminated, enlarged image of the site of interest toward the eyes of the individual holding the instrument.

2. Status of Prior Art

The configuration of the human body is such that an individual who is not a contortionist is only able to directly view limited portions of his body, such as his arms and legs and frontal torso. A person cannot see his buttocks nor can he directly look into his ears or mouth. But by means of a mirror or a combination thereof, one can establish an optical path between the eyes and a body orifice or any body site of interest. As a practical matter, however, this is difficult to do without some means to hold the various mirrors at set angular positions.

Moreover, when using an arrangement of planar mirrors for this purpose, say, to inspect the anus, the length of the optical path between the eyes and the anus is such that the image seen by the eyes is far too small for proper inspection. And unless the ambient light level is high, the image, to the extent it can be seen, is dimly illuminated.

To facilitate shaving or make-up, it is known to provide a concave magnifying mirror having a lighting accessory, the mirror being wall-mounted on a hinged bracket so that it can be angularly adjusted for proper viewing. In this instance, the viewer sees an enlarged and well-illuminated reversed image of the face. But a device of this type is, for obvious reasons, not usable for personal inspection of the vagina or anus. Furthermore, a reverse image presents problems when the viewer is seeking, say, to cut hairs out of his ears with a scissors or carry out some other mechanical operation with his fingers which he sees in the magnifying mirror but in reverse relation, thereby making manipulation of the scissors difficult.

On occasion, one may need to conduct in the privacy of the home a personal inspection of the vagina, the anus or other visually inaccessible body site of interest. Thus, an individual may wish to see if there are piles or other eruptions at the site of interest, a skin discoloration or other abnormality that may require medical attention. There exists, however no commercially-available instrument for this purpose.

While physicians are equipped with various types of illuminated optical inspection instruments, even if these were available to individuals, they are not suitable for personal use without assistance. Thus, while an individual could bring such an inspection instrument (such as an endoscope) near his anus, he is in no position to look into the instrument. One could, in theory, couple an image-transmitting fiber optic cable to the eyepiece of the instrument, but such cables are very costly.

SUMMARY OF INVENTION

In view of the foregoing, the main object of this invention is to provide an optical personal inspection instrument making it possible for an individual without assistance to examine a body orifice such as the anus or vagina, or any other body site of interest not otherwise viewable.

The advantage of an instrument in accordance with the invention does not lie in the fact that it allows an individual to make his own medical diagnosis, for this entails specialized knowledge that few individuals possess, but in enabling the individual to see and then report to a physician a body abnormality that may require medical attention.

In this modern era, doctors have ceased to make house calls and can be consulted only during regular office hours. But doctors are usually reachable at all hours by phone, and it is helpful in such circumstances to be able to report to a doctor a worrisome condition seen by personal inspection. One can, on this basis, solicit the physician's advice in an emergency situation without the need for an office visit. And when an individual is being treated by a physician, it may then be desirable to be able from time to time to inspect the body site being treated to see whether the condition in question is undergoing change, for better or worse, without having to return to the doctor's office.

More particularly, an object of this invention is to provide a hand-held instrument of the above type which affords the viewer a clear, well-illuminated and enlarged image of the site of interest so that a proper personal examination can be made. Thus, no need exists to set up the instrument on a tripod, a bed or an examination table, for the instrument is held by the individual as he conducts the examination.

Also an object of the invention is to provide an instrument which can be manufactured at low cost and which operates efficiently and reliably.

Briefly stated, these objects are attained in an optical personal inspection instrument enabling an individual, without any assistance, to examine a body orifice or any other body site otherwise not visually accessible. The instrument is provided with a hand-held platform on which a flashlight unit is hingedly supported by an adjustable beam whereby the unit may be more or less raised with respect to the platform and angled to assume an orientation at which a light beam projected from the unit is directed to illuminate the site of interest. Supported behind and above the unit at the upper end of a telescoping arm of adjustable length is a concave mirror, the lower end of the arm being hingedly attached to the adjustable beam at a point thereon adjacent its lower end. Supported in front and below the unit by an adjustable linkage hingedly attached to the front end of the unit is a concave magnifying mirror, whereby this mirror may be oriented to receive and enlarge a reversed image of the illuminated site and to cast this image on the concave mirror which reverses the reversed image and directs it to the eyes of the individual.

OUTLINE OF DRAWINGS

For a better understanding of the invention as well as other objects and further features thereof, reference is made to the following detailed description to be read in conjunction with the accompanying drawings, wherein:

FIG. 3 shows the instrument when used to inspect an individual's ear; and

DESCRIPTION OF INVENTION

The Instrument

Figure 1:
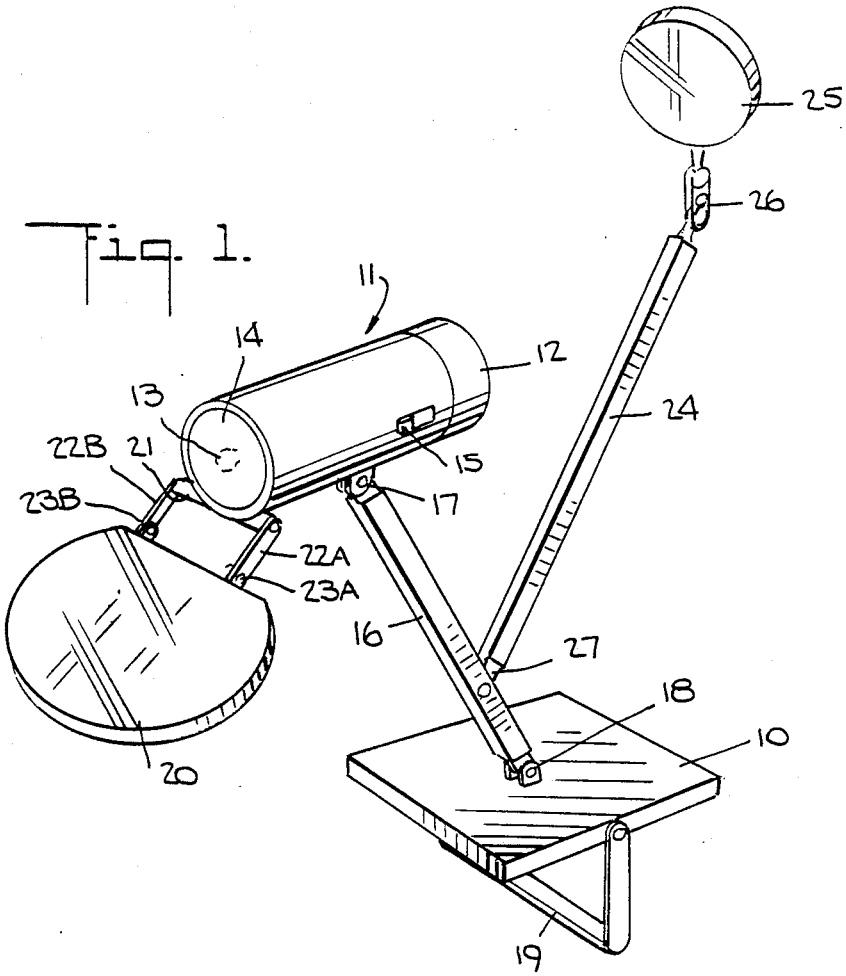
FIG. 1 illustrates a personal optical inspection instrument according to the invention.
Figure 4:
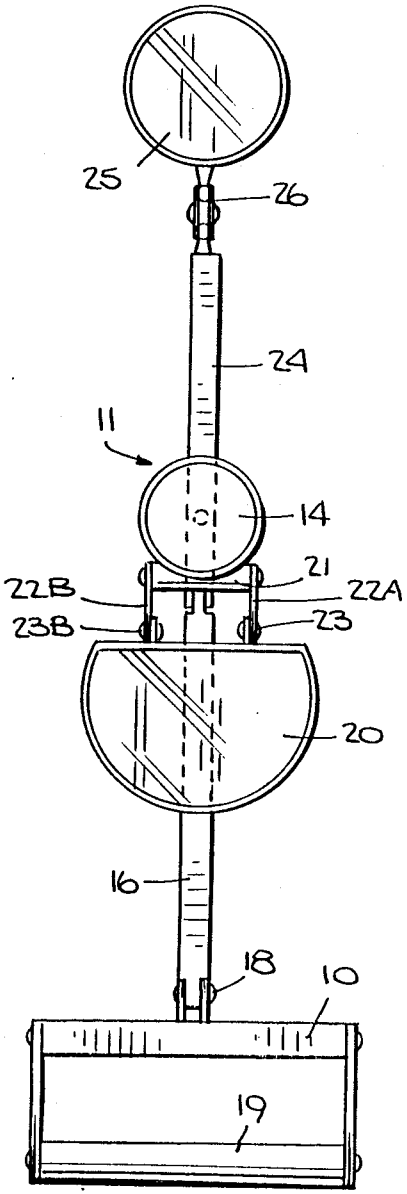
FIG. 4 is a front elevation of the instrument.
Figure 5:
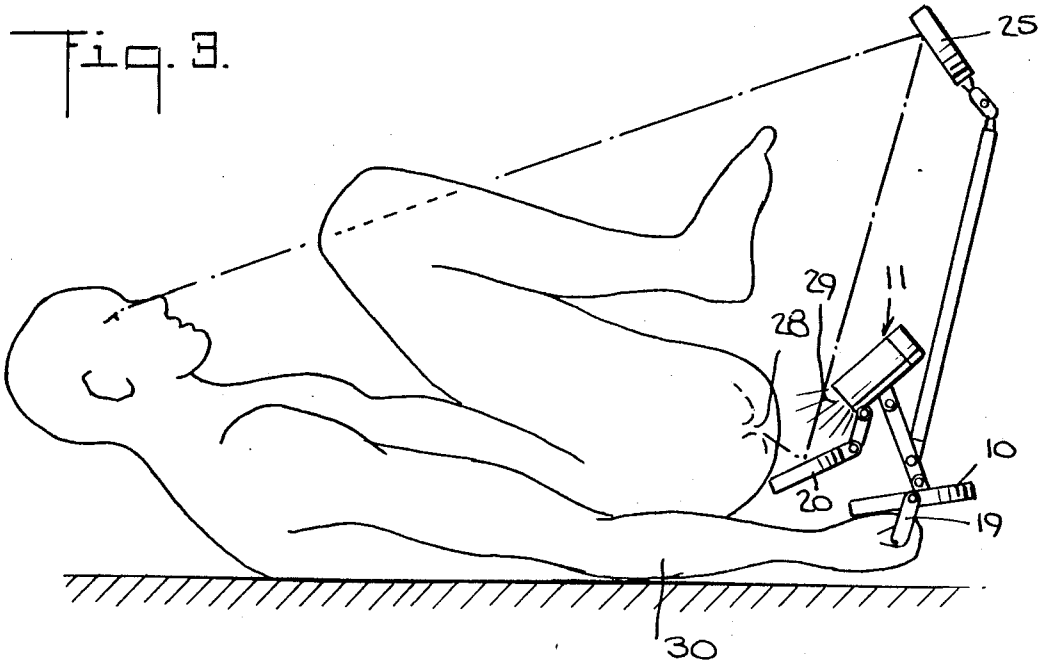

Referring now to FIGS. 1 & 4, there is shown a personal inspection instrument according to the invention, the instrument including a platform 10 made of lightweight, synthetic plastic material such as polypropylene or polycarbonate, or of aluminum or other suitable high-strength material. Supported above platform 10 is a battery-powered flashlight unit 11 provided with a cylindrical casing within which batteries are housed. The casing is provided with a removable rear cap 12 to permit battery replacement. At the front end of the casing is a light bulb 13 covered by a lens 14 adapted to project a conical light beam. Also provided is an on-off switch 15.

Flashlight unit 11 is supported at the upper end of an adjustable beam 16 having a square cross section, the beam being pivotally attached to the casing at its upper end by a hinge 17. The lower end of beam 16 is pivotally attached by a hinge 18 to the upper face of platform 10. This adjustable beam makes it possible to more or less raise flashlight unit 10 above the platform as well as to so angle the unit as to project a light beam toward a body site of interest. Attached to the undersurface of platform 10 is a handle 19 which may be pivoted thereon, thereby making it convenient for an individual holding the instrument by the handle to point it in any desired direction since the body site of interest may be at the front, rear or side of the body, and the individual must therefore assume a posture making inspection possible with the instrument.

Supported forwardly of the flashlight unit by an adjustable linkage is a concave magnifying mirror 20. This linkage is constituted by a cross bar 21 attached to the underside of the casing, having pivotally attached thereto at its opposite ends a pair of parallel links 22A and 22B. The ends of the links are attached to the straight base of concave mirror 20 by hinges 23A and 23B. This linkage makes it possible to more or less lower concave mirror 20 with respect to the light beam projected by the flashlight unit and to adjust the angle of the mirror.

Since concave mirror 20 is supported by the adjustable linkage from the front end of flashlight unit 11, when the unit is raised or lowered, or angled with respect to platform 10, the concave mirror which is carried by the unit is shifted accordingly.

Supported at the upper end of a telescoping arm 24 by a double hinge 26 is a planar mirror 25, the lower end of arm 24 being attached by a hinge 27 to beam 16 at a point adjacent hinge 18. Thus, the length of arm 24 is adjustable as well as the angle between arm 24 and beam 16 and the angle of planar mirror 25 relative thereto. And since planar mirror 25 is mounted by arm 24 on adjustable beam 16, as beam 16 is adjusted, so is the position of planar mirror 25.

In using this instrument, the individual whose wishes to inspect an otherwise visually inaccessible site on his body makes the following adjustments to establish an optical path between the site of interest and his eyes.

A. He adjusts the elevation of the flashlight unit 11 and its angular orientation, so that when platform 10 is held, a light beam is projected toward the body site of interest.

B. He adjusts the linkage supporting concave mirror 20 so that it can pick up the illuminated body site and produce an enlarged reversed image thereof.

C. He adjusts telescoping ar 24 and planar mirror 25 supported thereby so that this mirror receives the reversed and enlarged illuminated image from concave mirror 20, and reverses it and directs it toward the eyes of the individual holding the instrument.

Since the platform is held in one hand, the individual is able with his other hand, while looking into the planar mirror to adjust its position and to adjust the orientation of the flashlight unit and the magnifying mirror so as best to receive an image of the body site of interest.

When the instrument is not in use, it may be collapsed into a compact form for purposes of storage by resting beam 16 on platform 10, retracting the telescoping arm 24 and swinging planar mirror 25 down against the arm and swinging the linkage for the concave mirror against the front of the flashlight unit.

Applications

Figure 2:
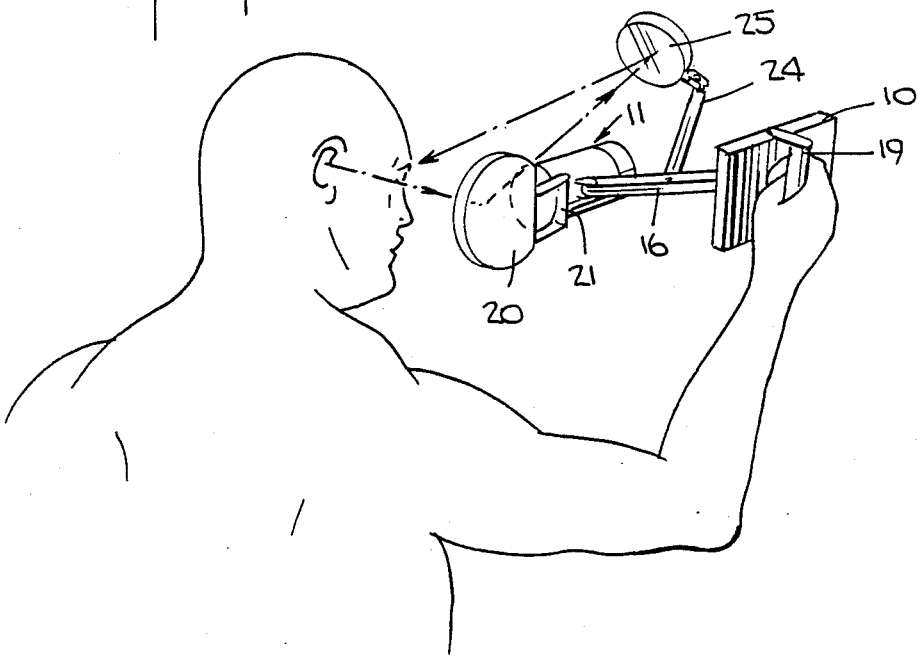
FIG. 2 shows an individual holding the instrument and assuming a posture such as to expose his anus to the instrument.

We shall now in connection with FIG. 2 show how an individual who wishes to inspect his anus uses the instrument for this purpose. The individual lies on a bed or on a flat surface and bends and pulls back his legs so as to expose his anus 28 to the light beam 29 projected by the flashlight unit of the instrument which the individual holds in the hand of his forwardly-extended arm 30.

Concave mirror 20 is now so angled as to produce an illuminated and enlarged reversed image of the anus and cast it on planar mirror 25 which reverses the reversed image and directs it toward the eyes 31 of the individual. Because the optical path from the anus to the eyes includes two mirrors, the reversed image formed by magnifying mirror 20 is reversed by planar mirror 25 to present a non-reversed, enlarged and illuminated image to the eye of the individual holding the instrument, which is clearly visible despite the relatively long optical path from the anus to the eyes Thus, it becomes possible for this individual to inspect his anus and to see whether any eruption or other abnormal condition exists that may require medical attention.

A male may readily examine his sexual organ by assuming an appropriate position convenient for inspection by the hand-held instrument, and a female may, using the same instrument, inspect the external parts of her genital organ. The adjustments for this purpose in the orientation of the flashlight unit and of the mirrors are, of course, those appropriate to the location of the site of interest and the posture assumed by the individual to facilitate inspection.

As shown in FIG. 3, the instrument may be hand-held for the purpose of an ear examination, in which case the light beam is directed toward the ear 31, and mirrors 20 and 25 are then angled to provide an optical path between the ear and the eyes.

While there has been shown and described a preferred embodiment of an optical personal inspection instrument in accordance with the invention, it will be appreciated that many changes and modifications may be made therein without, however, departing from the essential spirit thereof. Thus, instead of being hand-held, the instrument may be supported on a tripod or on a gooseneck that can be clamped to any suitable supporting surface.

We claim:

1. An illuminated optical personal inspection instrument making it possible for an individual, without any assistance, to examine a body site of interest not otherwise visually accessible, said instrument comprising:

A a platform;

B an orientable flashlight unit supported above the platform to project a light beam toward the body site of interest;

C a magnifying concave mirror adjustably supported on the front end of the unit at a forward position below the unit, said concave mirror being settable to receive and enlarge a reversed image of the illuminated site; and D a planar mirror supported rearwardly and above the unit, said planar mirror being settable to receive and reverse the illuminated reversed image from the concave mirror and to direct an unreversed enlarged image toward the eyes of the individual.

2. An instrument as set forth in claim 1, wherein said platform is provided with a handle so that the instrument can be hand-held.

3. An instrument as set forth in claim 1, wherein said unit is supported at the upper end of an adjustable beam by a hinge, the lower end of the beam being hinged to the upper face of the platform whereby the flashlight unit may be more or less raised with respect to the platform and angled.

4. An instrument as set forth in claim 3, wherein said unit includes a cylindrical casing housing batteries, a lens being provided at the front end of the casing to cover a light bulb energized by the batteries.

5. An instrument as set forth in claim 4, wherein said concave mirror is supported by a linkage constituted by a transverse bar attached to the underside of the casing at the front end thereof and a pair of parallel links pivotally attached to opposite ends of the bar, the ends of the links being hingedly attached to the concave mirror.

6. An instrument as set forth in claim 3, wherein said planar mirror is supported at the upper end of a telescoping arm to which it is hingedly attached, the lower end of the arm being hinged to the beam at a point adjacent its lower end.

7. An instrument as set forth in claim 1 wherein said platform is formed of aluminum.

* * * * *